US007458787B2

(12) United States Patent
Brown

(10) Patent No.: US 7,458,787 B2
(45) Date of Patent: Dec. 2, 2008

(54) APPARATUS AND METHOD FOR REDUCING GAS LOCK IN DOWNHOLE PUMPS

(75) Inventor: Thaddeus Leon Brown, Amarillo, TX (US)

(73) Assignee: Harbison-Fischer, Inc., Crowley, TX (US)

( * ) Notice: Subject to any disclaimer, the term of this patent is extended or adjusted under 35 U.S.C. 154(b) by 675 days.

(21) Appl. No.: 11/092,258

(22) Filed: Mar. 29, 2005

(65) Prior Publication Data

US 2005/0226752 A1 Oct. 13, 2005

Related U.S. Application Data

(60) Provisional application No. 60/562,207, filed on Apr. 13, 2004.

(51) Int. Cl.
*F04B 43/00* (2006.01)
*E21B 43/00* (2006.01)

(52) U.S. Cl. ..... 417/555.2; 166/68; 166/105

(58) Field of Classification Search ..... 417/435, 417/555.2; 166/369, 68, 105
See application file for complete search history.

(56) References Cited

U.S. PATENT DOCUMENTS 2,371,846 A 3/1945 Ruthven
3,479,958 A 11/1969 Anderson et al.
3,578,886 A 5/1971 Nino
3,953,155 A 4/1976 Roeder
3,966,360 A 6/1976 Greene
4,643,258 A 2/1987 Kime
4,867,242 A 9/1989 Hart
4,968,226 A 11/1990 Brewer
5,651,666 A 7/1997 Martin
6,193,476 B1 * 2/2001 Sweeney ..... 417/401
6,273,690 B1 8/2001 Fischer, Jr. et al.
6,746,222 B2 6/2004 Skillman

* cited by examiner

*Primary Examiner*—Charles G Freay
(74) *Attorney, Agent, or Firm*—Geoffrey A. Mantooth

(57) ABSTRACT

The pump has a barrel with vent ports located therein and a plunger that reciprocates inside the barrel. The barrel has a standing valve and the plunger has a traveling valve. The plunger has a first portion with a seal between the plunger and the barrel and a second portion with a clearance between the plunger and the barrel. On the downstroke, gas contained in the compression chamber between the two valves vents through the clearance and out of the barrel through the vent port into the well bore. When the plunger contacts liquid in the compression chamber, the liquid enters the clearance and forms a seal, wherein the plunger traveling valve opens. The plunger can also be equipped with a second traveling valve and a vent in the plunger between the two traveling valves in order to equalize pressure across the first traveling valve at the bottom of the downstroke. This enables the standing valve to open much faster on the upstroke.

12 Claims, 5 Drawing Sheets

APPARATUS AND METHOD FOR REDUCING GAS LOCK IN DOWNHOLE PUMPS

This application claims priority to U.S. provisional application Ser. No. 60/562,207, filed Apr. 13, 2004.

FIELD OF THE INVENTION

The present invention relates to downhole pumps and pumping methods that are used in oil and gas wells, and in particular to pumps and pumping methods that produce quantities of gas that are capable of interfering with the lifting of liquid to the surface.

BACKGROUND OF THE INVENTION

When an oil well is first drilled and completed, the fluids (such as crude oil) may be under natural pressure which is sufficient to produce on its own. In other words, the oil rises to the surface without any assistance.

In many oil wells, and particularly those in fields that are established and aging, natural pressure has declined to the point where the oil must be artificially lifted to the surface. Subsurface pumps are located in the well below the level of the oil. A string of sucker rods extends from the pump up to the surface to a pump jack device, or beam pump unit. A prime mover, such as a gasoline or diesel engine, or an electric motor, or a gas engine on the surface causes the pump jack to rock back and forth, thereby moving the string of sucker rods up and down inside of the well tubing.

The string of sucker rods operates the subsurface pump. A typical pump has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges a compression chamber between the valves with fluid and then lifts the fluid up the tubing towards the surface. The one-way valves open and close according to pressure differentials across the valves.

Pumps are generally classified as tubing pumps or insert pumps. A tubing pump includes a pump barrel which is attached to the end joint of the well tubing. The plunger is attached to the end of the rod string and inserted down the well tubing and into the barrel. Tubing pumps are generally used in wells with high fluid volumes.

An insert pump has a smaller diameter and is attached to the end of the rod string and run inside of the well tubing to the bottom. It is held in place by a hold-down device that seats into a seating nipple installed on the tubing. The hold-down device also provides a fluid seal.

The volumetric efficiency of the pump is reduced in wells that have gas. The compression chamber between the standing and traveling one-way valves fails to fill completely with liquid. Instead, the compression chamber contains undissolved gas, air or vacuum, which are collectively referred to herein as "gas".

The gas may be undissolved from the liquid ("free gas") or it may be dissolved in the liquid until subjected to a drop in pressure in an expanding compression chamber, wherein the gas comes out of solution.

The presence of gas in the compression chamber reduces the efficiency of the pump, wherein the lifting costs to produce the oil to the surface are increased. Gas takes the place of liquid in the compression chamber, reducing efficiency. This condition is known as "gas interference".

The presence of too much gas in the compression chamber can completely eliminate the ability of the pump to lift fluid. This is because the gas in the compression chamber cannot be compressed into a pressure high enough to overcome the hydrostatic pressure on the traveling valve. This condition is known as "gas locked", and is a type of gas interference.

In common field practice, a common method to break a gas lock in a conventional pump is to space the pump setting and tag the pump hard. This is done in an effort to jar the valve open so as to break a gas lock. Hitting the pump to open the valves causes damage to pump components and the rod string. Other prior art attempts to solve the gas lock problem have concentrated on the valves and the compression of a gas in the compression chamber.

Operating the pump in a gas locked condition is undesirable because energy is wasted in that the pump is reciprocated but no fluid is lifted. The pump, sucker rod string, surface pumping unit, gear boxes and beam bearings can experience mechanical damage due to the downhole pump plunger hitting the liquid-gas interface in the compression chamber on the downstroke. Loss of liquid lift leads to rapid wear on pump components, as well as stuffing box seals. This is because these components are designed to be lubricated and cooled by the well liquid.

Gas locking not only damages the pump and stuffing box, but can reduce the overall productivity of the well. Producing gas without the liquid component removes the gas from the well. The gas is needed to drive the liquid from the formation into the well bore.

Still another problem arises in the Texas Panhandle, where some oil fields have a minimum gas-to-oil ratio production requirement. In other words, both gas and oil must be produced. Many gas wells are unable to produce gas at their full potential because the downhole pumps are unable to lift the liquid oil, as the pumps are essentially gas locked.

Still another problem arises in stripper wells, which are wells that produce ten barrels or less of liquid each day. Stripper wells are low volume wells. The output from a stripper well is produced into a stock tank on the surface. Separation equipment, which separates the gas from the well, is not used because the production volume is too low to justify the expense of separation equipment. The gas is vented off of the stock tank into the atmosphere, contributing to air pollution and a waste of natural gas.

Still another problem arises in wells with little or no "rat hole". The rat hole is the distance between the deepest oil, gas and/or water producing zones and the plugged back, or deepest, depth of the well bore. Conventional downhole pumps cannot pump these wells to their full potential due to the low working submergence of the pump in the fluid. The low submergence results in both liquid and gas being sucked into the compression chamber. If insufficient volumes of liquid are drawn in, the pump is gas locked. In low volume wells, the common practice is to shut the pump off for a period of time to allow the liquid to enter the well bore. But, in wells with little or no rat hole, shutting the pump off has no effect because the liquid level is low. Deepening the well bore is typically too expensive. These wells contain oil, but cannot be produced with prior art pumps.

SUMMARY OF THE INVENTION

It is an object of the present invention to provide a downhole pump and method that addresses the problems associated with gas lock and gas interference.

The present invention provides a downhole pump that comprises a barrel and a plunger. The barrel has first and second ends, with a first one-way valve located adjacent to the second, lower, end, with the barrel comprising a vent port at a location intermediate the first end and the first one-way valve. The plunger has first and second ends and is located inside of the barrel such that the first one-way valve is closer to the plunger second end than to the plunger first end. The plunger is capable of reciprocating inside of the barrel. The plunger has a second one-way valve. The compression chamber is formed between the first one-way valve and the second one-way valve. A seal is between the plunger and the barrel with the seal located between the vent port and the barrel first end. There is also a clearance between the plunger and the barrel with the clearance located between the seal and the plunger second end. The clearance communicates with the compression chamber and the vent port. Gas in the compression chamber can escape the barrel through the clearance and the vent port.

In accordance with one aspect of the present invention, the pump is an insert pump and further comprises a hold-down coupled to the barrel for coupling the barrel inside of the tubing. The vent port in the barrel is located downhole of the hold-down.

In accordance with another aspect of the present invention, the hold-down is located adjacent to the barrel first end.

In accordance with still another aspect of the present invention, the hold-down is located intermediate of the barrel first and second ends.

In accordance with another aspect of the present invention, the pump is a tubing pump with the barrel structured and arranged to be an extension of tubing.

In accordance with still another aspect of the present invention, the pump comprises a third one-way valve located in the plunger between the second one-way valve and the plunger first end. The plunger has a vent port located between the second and third one-way valves.

In accordance with still another aspect of the present invention, the plunger vent port communicates with the barrel vent port near the top of an upstroke of the plunger in the barrel.

In accordance with still another aspect of the present invention, the seal is an elastomeric member between the plunger and the barrel.

The present invention also provides a method of venting free gas in a downhole pump in a well comprising a barrel with a first one-way valve and a plunger with a second one-way valve, there being a compression chamber located between the first and second one-way valves. The plunger is reciprocated inside of the barrel so as to expand and contract the compression chamber between the first and second one-way valves. As the compression chamber expands, fluid is allowed to flow into the compression chamber. As the compression chamber contracts, free gas in the compression chamber is vented past a portion of the plunger and out of the barrel while maintaining a seal between another portion of the plunger and the barrel. When the compression chamber empties of free gas while continuing to contract the compression chamber, the fluid is pressurized in the compression chamber to open the second one-way valve.

In accordance with one aspect of the present invention, the pump produces fluid into tubing that extends from the pump to the surface. There is provided the step of collecting the vented free gas from the casing at the surface from a location outside of the tubing.

In accordance with still another aspect of the present invention, the plunger is reciprocated inside of the barrel so as to expand and contract the compression chamber in any angled orientation to the horizontal.

In accordance with still another aspect of the present invention, the plunger has a third one-way valve with the second one-way valve located between the compression chamber and the third one-way valve. The space between the second and third one-way valves is vented out of the barrel when the compression chamber is near full contraction.

DESCRIPTION OF THE PREFERRED EMBODIMENTS

Figure 1:
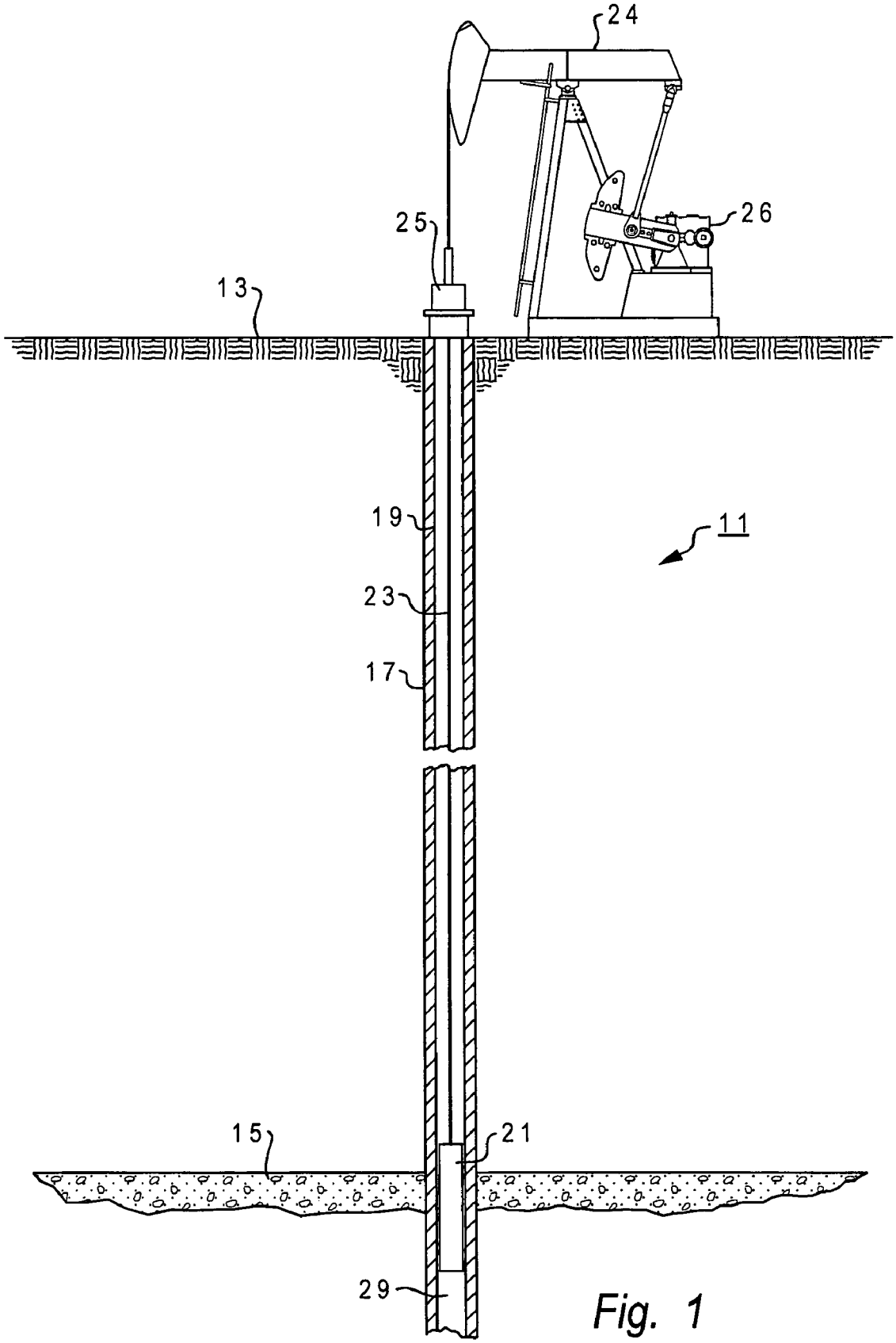
FIG. 1 is a schematic diagram of a well, shown with pumping equipment.

In FIG. 1, there is shown a schematic diagram of a producing oil well 11. The well has a borehole that extends from the surface 13 into the earth, past an oil bearing formation 15.

The borehole has been completed and therefore has casing 17 which is perforated at the formation 15. A packer or other method (not shown) optionally isolates the formation 15 from the rest of the borehole. If a packer were used, it would be located so as not to interfere with the pump of the invention. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod and a stuffing box 25 on the surface 13. The sucker rod string 23 is connected to a pump jack unit 24 which reciprocates up and down due to a prime mover 26, such as an electric motor, or a gasoline or diesel engine, or a gas engine. Below the zone 15 is a rat hole 29.

Figure 2:
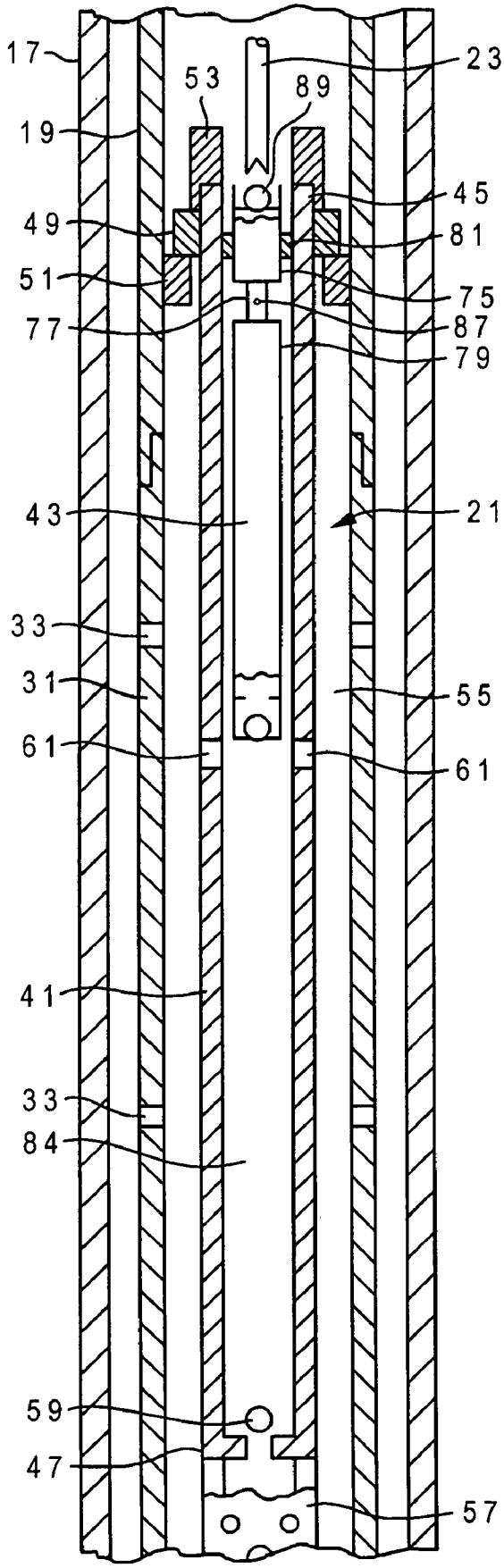
FIG. 2 is a longitudinal cross-sectional view of the pump of the present invention, in accordance with a preferred embodiment, shown in the upstroke.

As shown in FIG. 2, a length of slotted mud anchor 31 is attached to, and forms an extension of, the lower end of the tubing. The mud anchor 31 has openings 33 along its length.

The downhole pump 21 can be a top hold-down pump or a tubing pump. In the description that follows, the pump is a top hold-down pump.

Figure 3:
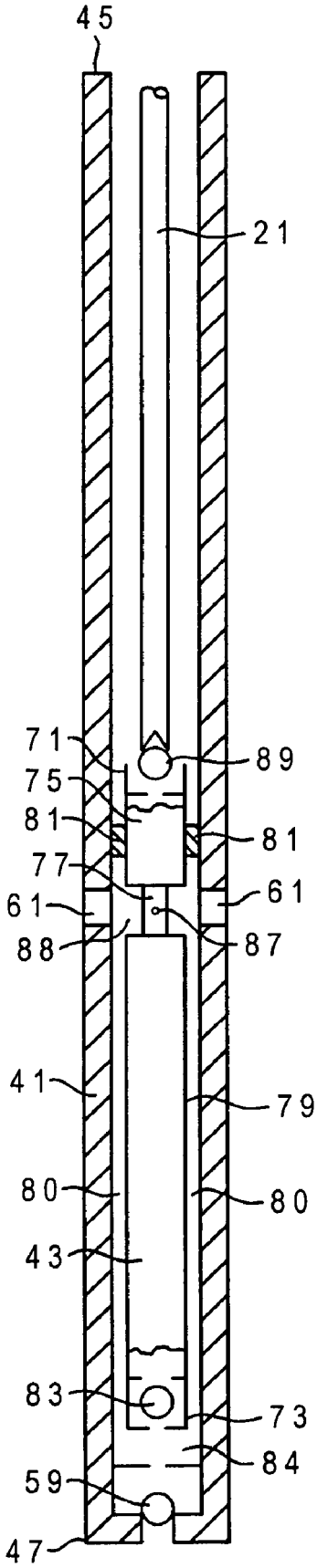
FIG. 3 is a longitudinal cross-sectional view of the pump, shown in the downstroke.

Referring to FIGS. 2 and 3, the pump 21 has a barrel 41 and a plunger 43. The barrel 41 is fixed to the tubing 19 (or in the case of a tubing pump, it is integrated into the tubing) and remains stationary, while the plunger 43 is fixed to the sucker rod string 23 and reciprocates within the barrel.

The barrel 41 is elongated and has first and second ends 45, 47. The barrel 41 can be a single piece, or can be made of several pieces joined together. The first end 45 has a hold-down 49, which is received by a seating nipple 51 in the tubing 19. The hold-down 49 and seating nipple 51 prevent fluid in the well tubing above the pump from flowing back into the well bore. The first end 45 of the barrel also has a mandrel and guide 53. The barrel 41 extends from the seating nipple 51 into the mud anchor 31. The mud anchor is below the well fluid level. An annulus 55 is located between the barrel 41 and the mud anchor 31. A straining nipple 57 is coupled to the second end 47 of the barrel 41. A standing one-way valve 59 is provided in barrel 41 at or near the second end 47.

The barrel has one or more vent ports 61 or openings intermediate the first and second ends 45, 47. The location of the vent ports 61 is dependent upon the plunger position and will be discussed further below. The vent ports 61 can be arranged circumferentially around the barrel and can be spaced longitudinally along some length of the barrel. The vent ports 61 are sized to allow gas and some fluid to flow therethrough. For example, each vent port can be ¼ inch in diameter. The diameter of the vent ports can be lined with inserts. The inserts are made of hardened material and minimize wear or erosion.

The barrel 41 can be two stock, or off the shelf, barrels joined together by a perforated coupling, which coupling perforations form the vent ports 61. Such a barrel is useful in pumps where the pump stroke is long and a one-piece barrel of sufficient length is not in stock. Also, use of a perforated coupling allows the use of plated barrels that cannot be drilled.

The plunger 43 is also elongated and has first and second ends 71, 73. The first end 71 of the plunger is coupled to a pull rod or tube, which in turn is coupled to the sucker rod string 23. The pull rod or tube protrudes out of the pump barrel through the hold down 49 and the mandrel and guide 53. The plunger 43 has a first portion 75, an intermediate portion 77 and a second portion 79. The first portion 75 extends from the first end 71 to the intermediate portion 77, while the second portion 79 extends from the second end 73 to the intermediate portion 77. The first portion 75, the intermediate portion 77 and the second portion 79 are hollow tubes.

The first portion 75 has a seal 81 between itself and the barrel 41. The seal 81 can be provided by a number of positive seal devices, such as valve cups, composition rings, flexite rings, pressure activated plunger rings (PAP rings) or other types of sealing rings. In addition, the seal 81 could be formed by a tight clearance between the plunger first portion and the barrel. For example, the clearance could be such that the outside diameter of the plunger first portion 75 is sized between 0.001-0.003 inches smaller than the inside diameter of the barrel. This small clearance allows a small amount of oil to enter the clearance for a fluid seal and lubrication purposes, but with negligible leaking. The length of the plunger first portion 75 is designed to form a fluid seal that can withstand the hydrostatic pressure of fluid in the tubing. For example, for a shallow well, the plunger first portion is 1-2 feet in length. For deeper wells, the plunger first portion may be 6 feet long.

The seal 81 can be fixed to the barrel or the plunger. In the preferred embodiment, the seal 81 is either a pressure-activated plunger with rings or a valve cup plunger.

The second portion 79 of the plunger 43 has no positive seal devices between itself and the barrel 41. There is a clearance 80 between the second portion 79 and the barrel 41. The clearance 80 between the plunger second portion and the barrel is sized so as to allow gas to pass therethrough, while providing a fluid seal once liquid enters the clearance. In the preferred embodiment, the clearance is between 0.0001-0.040 inches on diameter. The size of the clearance depends on the viscosity of the liquid in the well, the length of the plunger and the hydrostatic pressure of the fluid above the plunger. I have tested a clearance of 0.004 inches on diameter (0.002 inches on each side of a plunger centered in the barrel) and found it to work well. Low viscosity well fluid will typically require a clearance of 0.002-0.008 inches on diameter. Wells with high viscosity liquids, low hydrostatic pressure or long plungers can use pumps with a larger clearance. Liquid that foams during pumping due to the presence of gas has a lower viscosity than unfoamed liquid.

The intermediate portion 77 is shown as having a significantly smaller diameter than the first and second portions 75, 79. The intermediate portion 77 could have the same outside diameter as the second portion 79.

A first traveling valve 83 is provided at or near the second end 73 of the plunger. (In FIGS. 2 and 3 the plunger is shown cut away at the two ends to show the traveling valves.) There is a compression chamber 84 in the barrel between the standing valve 59 and the first traveling valve 83. A second traveling valve 85 (see FIGS. 4 and 5) is provided in the intermediate portion 77. The second traveling valve 85 is optional. If the second traveling valve 85 is provided, then the intermediate portion 77 has a vent hole 87 located between the second traveling valve 85 and the first traveling valve 83. The vent hole 87 allows communication between the inside of the plunger 43 and the outside of the plunger. If the second traveling valve 85 is provided, then the plunger has a reduced outside diameter at the intermediate portion 77 so as to form a vent chamber 88. The vent hole 87 communicates with the vent chamber 88. A third traveling valve 89, located at or near the first end 71, can also be provided in the plunger if desired.

The plunger 43 and barrel vent ports 61 are located such that at the top of the upstroke of the plunger relative to the barrel, the vent ports 61 are uncovered by the plunger and at the bottom of the downstroke, the vent ports are covered by the plunger. The stroke of the plunger inside of the barrel is determined by the stroke length and the amount of fluid which is to be extracted by the pump. The seal 81 around the plunger first portion 71 does not pass the barrel vent ports 61 and remains between the vent ports 61 and the barrel first end 45. The plunger first portion 75 can be short. The plunger remains in the barrel at the top of the upstroke.

When the plunger is at the bottom of the downstroke, if the plunger has a second traveling valve 85, then the vent chamber 88 communicates with the barrel vent ports 61. The extent of this communication can be regulated by changing the set or bottommost position of the plunger 43 inside of the barrel 41.

The pump is installed by running it into the well inside of the tubing and seating it on the seating nipple 51. The pump barrel is located in the mud anchor 31, which is below the well fluid level, or if a mud anchor is not used in the casing 17.

Figure 4:
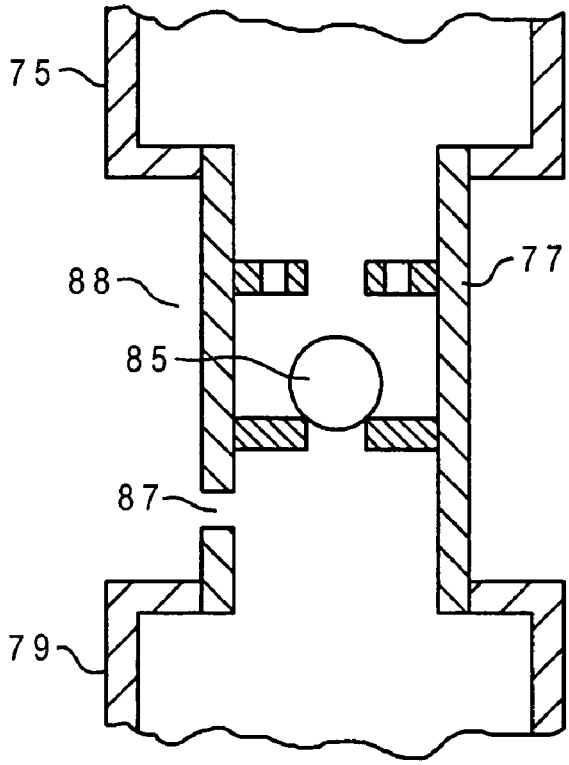
FIG. 4 is a detailed view of an intermediate one-way valve on the plunger, shown on the upstroke of the plunger.

In operation, the plunger 43 is reciprocated inside of the barrel 41. The upstroke is shown in FIGS. 2 and 4. As the plunger moves on the upstroke, the compression chamber 84 expands. The differential pressure across the standing valve 59 causes the standing valve 59 to open and fluid from the well bore enters the compression chamber 84. Some fluid is drawn into the barrel 41 through the barrel vent holes 61 near the top of the stroke. In addition to charging the compression chamber with the fluid, the fluid in the plunger and in the tubing is lifted because the traveling valves 83, 85, 89 are closed. The seal 81 prevents the fluid in the tubing from passing between the plunger and barrel.

The fluid in the compression chamber 84 typically includes liquid (for example oil and water) and gas. The gas can be free gas or dissolved in the liquid.

Figure 5:
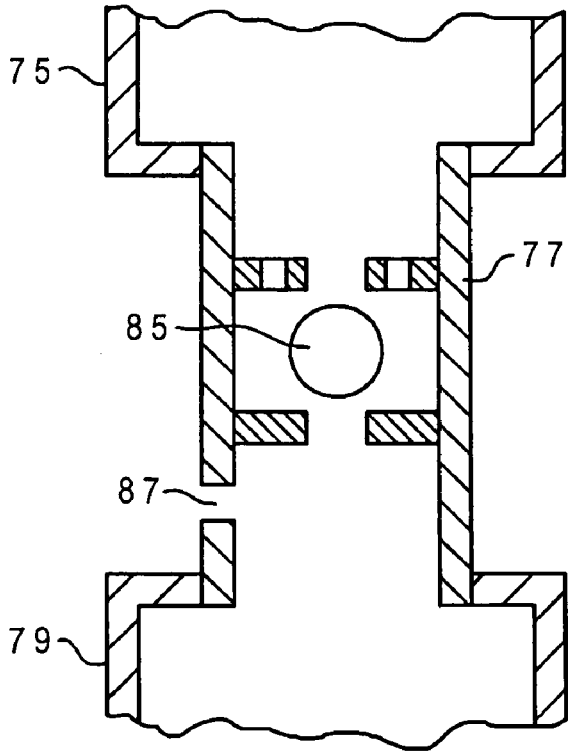
FIG. 5 is a detailed view of the intermediate valve of FIG. 4, shown on the downstroke of the plunger.

On the downstroke, shown in FIGS. 3 and 5, the plunger 43 moves and the compression chamber 84 shrinks in volume. Initially, the hydrostatic pressure in the tubing 19 maintains the traveling valves 83, 85, 89 in the closed position. As the compression chamber 84 shrinks, the gas located therein becomes compressed. The gas vents out of the compression chamber 84 by flowing through the clearance 80 between the plunger second portion 79 and the barrel 41 and out through the barrel vent ports 61. Any liquid in the clearance 80 is pushed out by the gas. Thus, the gas is vented from the compression chamber 84 out of the barrel 41. Once outside of the barrel, the gas flows through the openings 33 to the annulus around and outside of the tubing 19. The gas is prevented from flowing to the surface by way of the tubing by the three ring hold-down 49. The gas in the annulus is then allowed to move to the surface on its own.

In addition, some particulate matter is vented through the barrel vent ports 61, which particulate matter passes through the clearance 80. This vented particulate matter then falls to the bottom of the rat hole 29 (FIG. 1) or the bottom of the mud anchor 31.

Thus, the pump 21, tubing 19, and associated casing 17 provide an "open" system in that gas in the compression chamber can flow into the well annulus between the casing and the tubing. Prior art pumps provide a closed system, wherein the fluid and gas in the compression chamber can only flow into the tubing. The pump 21 of the present invention acts as a downhole gas separator. Most, if not all of the gas is separated downhole and is produced in the annulus between the tubing 19 and the casing 17. The liquid is produced and lifted in the tubing 19. A well equipped with the pump 21 may not need to have gas separation equipment on the surface, a feature that is particularly advantageous for stripper wells and other low output wells.

The venting of the gas from the compression chamber 84 cushions the plunger 43 when the plunger's second end 73 contacts the gas-liquid interface in the compression chamber, thereby minimizing damage to the pump components.

When the second end 73 of the plunger 43 contacts the liquid in the compression chamber 84, the free gas has been pushed out of the compression chamber through the clearance 80 between the plunger second portion and the barrel. The liquid then enters this clearance 80 and, being more viscous than the gas, effectively forms a seal between the plunger second portion 79 and the barrel 41. The pressure on the liquid in the compression chamber 84 increases until the traveling valves 83, 85, 89 open, wherein the liquid flows from the compression chamber 84 into the plunger 43. The second and third traveling valves 85, 89 open when the first traveling valve 83 opens because there is only liquid between the valves.

Better pump fillage can be achieved when optional traveling valve 85 is used. At the bottom of the downstroke, the pressure of the liquid in the compression chamber 84 and the plunger second portion 79 drops. This enables the second and third traveling valves 85, 89 to close due to the hydrostatic pressure of liquid in the tubing. The first traveling valve 83 does not immediately close because of the vent ports 61 and the vent hole 87 which present formation pressure to the surface side of the first traveling valve 83. This allows the pressure in the compression chamber 84 to equalize with formation pressure. In particular, any excess pressure in the compression chamber is released through the first traveling valve 83 into the formation through the vent ports 61 and vent hole 87. The practical advantage is that on the initiation of the plunger upstroke, the standing valve 59 opens much more quickly because the pressure differential needed to open the valve develops faster. The fast-opening standing valve 59 in turn provides for better pump fillage in that more fluid enters the compression chamber 84 on the upstroke.

The third traveling valve 89 is useful for keeping trash or debris out of the pump. Trash is typically particulates, such as sand (formation sand and frac sand), iron sulfides, salt, carbon, etc., which particulates interfere with the operation of the pump.

Any particulates that do enter the pump can become crushed by the second or third traveling valves 85, 89. The differential pressure across the second and third traveling valves is higher with the pump of the present invention because of the "open" system. Due to hydrostatic pressure, the pressure in the well tubing 19 is higher than the pressure in the well casing. For example, in a test well, the pressure differential was 675 psi for a 1950 foot tubing column. This is because the level of liquid in the well casing is lower than in the tubing (which extends to the surface). Because of the pressure differential between the liquid in the tubing 19 and the liquid in the casing 17 and the vent hole 87 below the second traveling valve, the second and third traveling valves 85, 89 close faster and more forcefully than does a traveling valve on a conventional pump.

The third traveling valve 89 is also useful as a backup to the other traveling valves 83, 85. If one of the other traveling valves should leak or fail to close, then the third traveling valve 89 will close and prevent liquid from leaking out of the pump through the vent ports 61 and hole 87.

Figure 6:
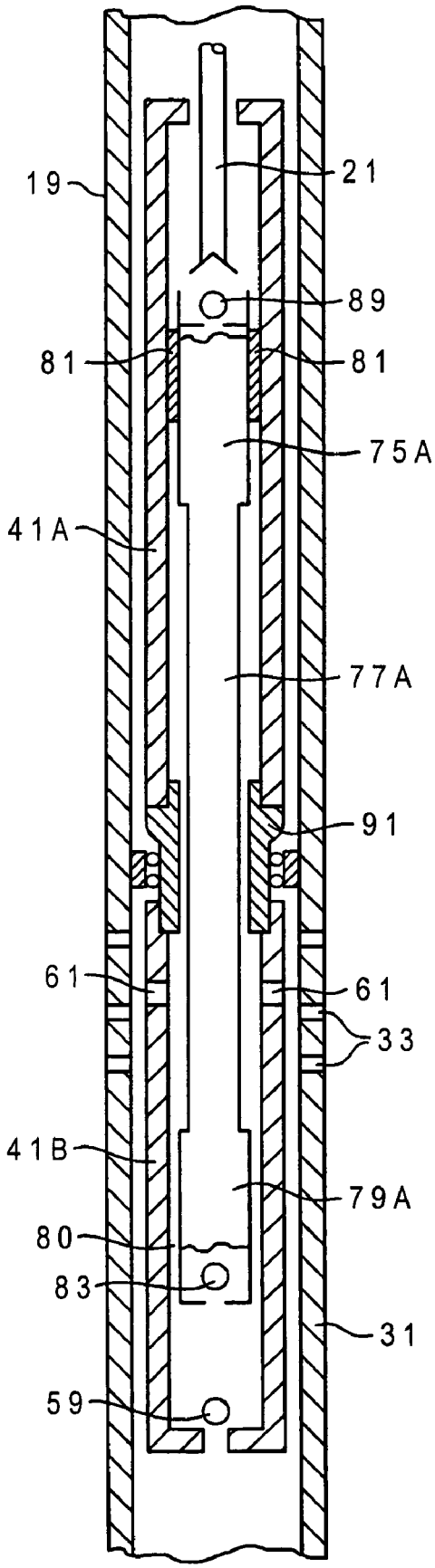
FIG. 6 is a longitudinal cross-sectional view of the pump of the present invention, in accordance with another embodiment, shown on the downstroke.

As shown in FIG. 6, a two-piece barrel can be used. This enables the pump to be installed in a well with a short mud anchor 31. Many wells use bottom hold down pumps, where the mud anchors are 5-10 feet long. Instead of pulling the tubing to install a longer mud anchor so that the top hold down pump of the present invention can be installed, a two-piece barrel 41A, 41B is used on the pump. The barrel has a seating assembly 91 at an intermediate position between the two barrel portions 41A, 41B. The vent ports 61 are located below the seating assembly 91. This effectively decreases the length of barrel extending into the mud anchor.

The plunger has first and second portions 75A, 79A and an intermediate portion 77A. The intermediate portion 77A is elongated so as to allow reciprocation through the seating assembly 91. Because of the seal 81, there need be no seal between the intermediate portion 77A and the seating assembly 91. The length of the plunger relative to the barrel and the seating assembly is designed so that the pump of FIG. 6 operates as described above, with respect to FIGS. 2-3. Although the pump of FIG. 6 is not shown with one, a second traveling valve 85 can be provided in the intermediate portion 77A, wherein the intermediate portion would have a vent hole 87.

Another advantage to using a two-piece barrel is lower repair costs. When the pump is pulled from a well with trash or debris, the upper portion of the pump, which contains the plunger seal 81, typically has no wear, while the lower portion does. Only the lower portion 41B of the barrel may need to be replaced.

With a tubing pump, the barrel is located on the end of well tubing. The barrel has the vent ports 61.

The pump is suitable for use in a vertical well as well as a horizontal well. The pump can be used at any orientation relative to the horizontal. The pump is particularly suited for horizontal gas locked wells which have difficultly using prior art pumps. The pump 21 relies not on gravity, but on pressure, to separate the gas from the liquid in the compression chamber. As the plunger 43 moves on the downstroke, thereby shrinking the compression chamber 84, the gas is forced out of the compression chamber by pressure. Thus, the pump can lie horizontally or even, in some circumstances, with the standing valve 59 above the first traveling valve 83. As long as some circumferential portion of the clearance 80 remains unimpeded by liquid, the gas can vent out of the clearance and out of the barrel by pressure.

Another advantage of the pump is that accurate bottom hole pressures can be obtained. Bottom hole pressures are useful in determining the productive life of a well or even an entire field. In the prior art, accurate bottom hole pressures are difficult to obtain due to fluctuation of the fluid level from the gas locked pump and also due to pump fluid emergence requirements. To measure bottom hole pressure, the pump is pulled and the well swabbed dry to eliminate the hydrostatic pressure of fluid in the tubing. In prior art pumps, this swabbing can take several hours or days. The pump of the present invention is able to keep the well fluids pumped down to a relatively low level and maintain that level with no fluctuation, thereby minimizing, if not eliminating, swabbing time in a bottom hole pressure measurement.

Still another advantage of the pump of the present invention is in paraffin management. Paraffin, which is carried in suspension in oil, drops out of suspension when the oil is subject to a change of pressure or temperature. With the pump of the present invention, paraffin problems are reduced because pressure changes in the oil are reduced. The fluid in the well bore does not fluctuate.

The pump of the present invention can extend the serviceable life of pump components to a considerable degree. For example, in prior art pumps, when the clearance between the barrel and the plunger is 0.008 inches or greater, then the barrel is considered worn and is not subject to further use. However, with the pump of the present invention, the barrel can be used. The first portion of the plunger has a seal which can engage the larger inside diameter of the barrel, while the lower portion of the plunger relies on clearance to vent the gas during the downstroke.

The pump of the present invention also allows the reciprocation speed to be varied over a considerable range. For example, the pump can be stopped in the topmost upstroke position. This exposes the barrel vent ports to the compression chamber. In this position, fluid from the well bore can enter the compression chamber 84 via the vent ports 61. Thus, the compression chamber can be filled with fluid without any action on the part of the pump. The fluid entering the pump would typically be mostly liquid. Any gas that enters can be vented out through the vent ports 61. Thus, on the downstroke, the compression chamber would be much fuller with liquid, which liquid will then pass through the first traveling valve. The lifting costs in the well can be reduced by operating the pump in an intermittent manner.

Also, because of the seal 81, the reciprocation speed of the plunger need not be designed for maintaining the seal between the plunger and the barrel as is true with prior art pumps.

The foregoing disclosure and showings made in the drawings are merely illustrative of the principles of this invention and are not to be interpreted in a limiting sense.

The invention claimed is:

1. A downhole pump, comprising:

a) a barrel having first and second ends, with a first one-way valve located adjacent to the second end, the barrel comprising a vent port at a location intermediate the first end and the first one-way valve;

b) a plunger having first and second ends and being located inside of the barrel such that the first one-way valve is closer to the plunger second end than to the plunger first end, the plunger capable of reciprocating inside of the barrel, the plunger has a second one-way valve, a compression chamber being formed between the first one-way valve and the second one-way valve;

c) a seal between the plunger and the barrel, the seal located between the vent port and the barrel first end;

d) a clearance between the plunger and the barrel, the clearance located between the seal and the plunger second end so as to communicate with the compression chamber and so as to communicate with the vent port, wherein gas in the compression chamber can escape the barrel through the clearance and the vent port, the clearance forming a seal to liquid in the compression chamber.

2. The pump of claim 1 wherein the seal is an elastomeric member between the plunger and the barrel.

3. A downhole pump, comprising:

a) a barrel having first and second ends, with a first one-way valve located adjacent to the second end, the barrel comprising a vent port at a location intermediate the first end and the first one-way valve;

b) a plunger having first and second ends and being located inside of the barrel such that the first one-way valve is closer to the plunger second end than to the plunger first end, the plunger capable of reciprocating inside of the barrel, the plunger has a second one-way valve, a compression chamber being formed between the first one-way valve and the second one-way valve;

c) a seal between the plunger and the barrel, the seal located between the vent port and the barrel first end;

d) a clearance between the plunger and the barrel, the clearance located between the seal and the plunger second end so as to communicate with the compression chamber and so as to communicate with the vent port, wherein gas in the compression chamber can escape the barrel through the clearance and the vent port;

e) a hold-down coupled to the barrel for coupling the barrel inside of the tubing, the vent port in the barrel located downhole of the hold-down.

4. The pump of claim 3 wherein the hold-down is located adjacent to the barrel first end.

5. The pump of claim 3 wherein the hold-down is located intermediate the barrel first and second ends.

6. A downhole pump, comprising:

a) a barrel having first and second ends, with a first one-way valve located adjacent to the second end, the barrel comprising a vent port at a location intermediate the first end and the first one-way valve;

b) a plunger having first and second ends and being located inside of the barrel such that the first one-way valve is closer to the plunger second end than to the plunger first end, the plunger capable of reciprocating inside of the barrel, the plunger has a second one-way valve, a compression chamber being formed between the first one-way valve and the second one-way valve;

c) a seal between the plunger and the barrel, the seal located between the vent port and the barrel first end;

d) a clearance between the plunger and the barrel, the clearance located between the seal and the plunger second end so as to communicate with the compression chamber and so as to communicate with the vent port, wherein gas in the compression chamber can escape the barrel through the clearance and the vent port;

e) the pump is a tubing pump, the barrel being structured and arranged to be an extension of tubing.

7. A downhole pump, comprising:

a) a barrel having first and second ends, with a first one-way valve located adjacent to the second end, the barrel comprising a vent port at a location intermediate the first end and the first one-way valve;

b) a plunger having first and second ends and being located inside of the barrel such that the first one-way valve is closer to the plunger second end than to the plunger first end, the plunger capable of reciprocating inside of the barrel, the plunger has a second one-way valve, a compression chamber being formed between the first one-way valve and the second one-way valve;

c) a seal between the plunger and the barrel, the seal located between the vent port and the barrel first end;

d) a clearance between the plunger and the barrel, the clearance located between the seal and the plunger second end so as to communicate with the compression chamber and so as to communicate with the vent port, wherein gas in the compression chamber can escape the barrel through the clearance and the vent port;

e) a third one-way valve located in the plunger between the second one-way valve and the plunger first end, the plunger having a vent port located between the second and third one-way valves.

8. The plunger of claim 7 wherein the plunger vent port communicates with the barrel vent port near the top of an upstroke of the plunger in the barrel.

9. A method of venting free gas in a downhole pump in a well having a casing, the pump produces fluid into tubing that extends from the pump to the surface, the pump comprising a barrel with a first one-way valve and a plunger with a second one-way valve, there being a compression chamber located between the first and second one-way valves, comprising the steps of:

a) reciprocating the plunger inside of the barrel so as to expand and contract the compression chamber between the first and second one-way valves;

b) as the compression chamber expands, allowing fluid to flow into the compression chamber;

c) as the compression chamber contracts, venting free gas in the compression chamber past a portion of the plunger and out of the barrel and out of the tubing into a space between the tubing and the casing while maintaining a seal between another portion of the plunger and the barrel;

d) when the compression chamber empties of free gas while continuing to contract the compression chamber, pressurizing the fluid in the compression chamber to open the second one-way valve.

10. The method of claim 9, further comprising the step of collecting the vented free gas from the casing at the surface from a location outside of the tubing.

11. The method of claim 9 wherein the step of reciprocating the plunger inside of the barrel so as to expand and contract the compression chamber further comprises the step of reciprocating the plunger in any angled orientation to the horizontal.

12. A method of venting free gas in a downhole pump in a well comprising a barrel with a first one-way valve and a plunger with a second one-way valve and a third one-way valve, there being a compression chamber located between the first and second one-way valves, with the second one-way valve located between the compression chamber and the third one-way valve, comprising the steps of:

a) reciprocating the plunger inside of the barrel so as to expand and contract the compression chamber between the first and second one-way valves;

b) as the compression chamber expands, allowing fluid to flow into the compression chamber;

c) as the compression chamber contracts, venting free gas in the compression chamber past a portion of the plunger and out of the barrel while maintaining a seal between another portion of the plunger and the barrel;

d) when the compression chamber empties of free gas while continuing to contract the compression chamber, pressurizing the fluid in the compression chamber to open the second one-way valve;

e) venting the space between the second and third one-way valves out of the barrel when the compression chamber is near full contraction.

* * * * *